US008961816B2

(12) United States Patent
Coda et al.

(10) Patent No.: US 8,961,816 B2
(45) Date of Patent: Feb. 24, 2015

(54) NON-EVAPORABLE GETTER ALLOYS PARTICULARLY SUITABLE FOR HYDROGEN AND NITROGEN SORPTION

(71) Applicant: Saes Getters S.P.A., Lainate (IT)

(72) Inventors: Alberto Coda, Gerenzano (IT); Alessandro Gallitognotta, Origgio (IT); Antonio Bonucci, Milan (IT); Andrea Conte, Milan (IT)

(73) Assignee: Saes Getters S.p.A. (IT)

( * ) Notice: Subject to any disclaimer, the term of this patent is extended or adjusted under 35 U.S.C. 154(b) by 0 days.

(21) Appl. No.: 14/348,350

(22) PCT Filed: May 13, 2013

(86) PCT No.: PCT/IB2013/053874
§ 371 (c)(1),
(2) Date: Mar. 28, 2014

(87) PCT Pub. No.: WO2013/175340
PCT Pub. Date: Nov. 28, 2013

(65) Prior Publication Data

US 2014/0252266 A1 Sep. 11, 2014

(30) Foreign Application Priority Data

May 21, 2012 (IT) ..... MI2012A0872

(51) Int. Cl.

| | |
|---|---|
| ***H01J 7/18*** | (2006.01) |
| ***H01J 35/20*** | (2006.01) |
| ***H01K 1/56*** | (2006.01) |
| ***C22C 14/00*** | (2006.01) |
| ***C22C 16/00*** | (2006.01) |

(52) U.S. Cl.
CPC ..... *H01J 7/183* (2013.01)
USPC ..... 252/181.6; 75/245; 75/255; 420/125; 420/126; 420/127; 420/422; 420/417; 420/420

(58) Field of Classification Search
None
See application file for complete search history.

(56) References Cited

U.S. PATENT DOCUMENTS

| | | | | |
|---|---|---|---|---|
| 3,666,429 | A * | 5/1972 | Campbell et al. | 428/633 |
| 3,740,830 | A * | 6/1973 | Campbell et al. | 228/121 |
| 4,360,445 | A | 11/1982 | Mendelsohn et al. | |
| 5,238,469 | A | 8/1993 | Briesacher | |
| 5,324,172 | A | 6/1994 | Manini et al. | |

(Continued)

FOREIGN PATENT DOCUMENTS

| | | |
|---|---|---|
| EP | 0719609 | 7/1996 |
| EP | 0869195 | 10/1998 |
| EP | 0910106 | 4/1999 |
| EP | 1704576 | 9/2006 |
| EP | 2071188 | 6/2009 |
| WO | 94/02958 | 2/1994 |
| WO | 98/43763 | 10/1998 |
| WO | 2005/073998 | 8/2005 |
| WO | 2010/105944 | 9/2010 |
| WO | 2010/105945 | 9/2010 |

OTHER PUBLICATIONS

PCT International Search Report mailed on Aug. 27, 2013 for PCT/IB2013/053874 filed on May 13, 2013 in the name of SAES Getters S.P.A.
PCT Written Opinion mailed on Aug. 27, 2013 for PCT/IB2013/053874 filed on May 13, 2013 in the name of SAES Getters S.P.A.
PCT International Preliminary Report on Patentability mailed on Feb. 21, 2014 for PCT/IB2013/053874 filed on May 13, 2013 in the name of SAES Getters S.P.A.

*Primary Examiner* — Joseph D Anthony
(74) *Attorney, Agent, or Firm* — Steinfl & Bruno LLP

(57) ABSTRACT

Getter devices based on powders of alloys particularly suitable for hydrogen and nitrogen sorption are described. Such alloys have a composition including zirconium, vanadium, titanium and, optionally, one or more elements selected from iron, chromium, manganese, cobalt, nickel and aluminum.

10 Claims, 7 Drawing Sheets

(56) References Cited

U.S. PATENT DOCUMENTS

| | | | | |
|---|---|---|---|---|
| 5,814,241 | A | 9/1998 | Reutova et al. | |
| 6,149,392 | A | 11/2000 | Conte | |
| 7,745,014 | B2 * | 6/2010 | Conte et al. | 428/613 |
| 8,025,838 | B2 * | 9/2011 | Neirinck et al. | 419/2 |
| 2004/0036168 | A1 * | 2/2004 | Bedinger et al. | 257/728 |
| 2004/0203313 | A1 * | 10/2004 | Ramamoorthi et al. | 445/31 |
| 2004/0253476 | A1 * | 12/2004 | Conte et al. | 428/660 |
| 2005/0085052 | A1 * | 4/2005 | Chen et al. | 438/471 |
| 2005/0085053 | A1 * | 4/2005 | Chen et al. | 438/471 |
| 2005/0169766 | A1 | 8/2005 | Gallitognotta et al. | |
| 2006/0164009 | A1 * | 7/2006 | Ramamoorthi et al. | 313/547 |
| 2007/0114429 | A1 * | 5/2007 | Bhadare | 250/370.09 |

* cited by examiner

NON-EVAPORABLE GETTER ALLOYS PARTICULARLY SUITABLE FOR HYDROGEN AND NITROGEN SORPTION

CROSS REFERENCE TO RELATED APPLICATIONS

The present application is the US national stage of International Patent Application PCT/IB2013/053874 filed on May 13, 2013 which, in turn, claims priority to Italian Patent Application MI2012A000872 filed on May 21, 2012.

The present invention relates to new getter alloys having an increased hydrogen and nitrogen capacity, to a method for sorbing hydrogen with said alloys and to hydrogen-sensitive devices which employ said alloys for the removal of hydrogen.

The alloys which are the subject-matter of this invention are particularly useful for all the applications which require sorption of significant quantities of hydrogen and nitrogen, even if used at high temperatures. The use of the getter alloys at high temperatures is important since it maximizes the capability of the alloys versus the other gaseous impurities, such as $H_2O$, $O_2$, CO, $CO_2$, but at the same time the use of the alloys in the state of the art at high temperatures negatively affects their capability versus the hydrogen removal, and in some cases the alloy itself may become a source of hydrogen contamination. Moreover, $N_2$ removal with the known getter alloys is usually negligible or not satisfactory, due to the well known low chemical reactivity of this gas.

Among the most interesting applications for these new sorbing materials there are solar collectors, with particular reference to receiving tubes which are an integral part of said systems, illumination lamps, vacuum pumps and gas purification.

The use of getter materials for hydrogen removal in these applications is already known, but the currently developed and used solutions are not suitable for meeting the requirements which are imposed by the continuous technological developments which set more and more rigid limits and constraints.

In particular, in the field of Concentrating Solar Power (usually indicated with the English acronym CSP) the presence of hydrogen and nitrogen is harmful. Also in the new generation of concentrators, the problems of the presence of hydrogen and nitrogen with the consequent efficiency decay of the solar collector are of particular relevance. Another field where the effective removal of hydrogen is required is in illumination lamps, with particular reference to high pressure discharge lamps and low pressure mercury lamps in which the presence not only of hydrogen even at low levels but also of nitrogen significantly decreases the lamp performance. More information regarding the degradation phenomena can be found in EP 1704576 relating to a different material for hydrogen and residual nitrogen sorption.

In this particular applicative field not only the material capacity to effectively sorb hydrogen at high temperatures is particularly important, but for some lamps also the low activation temperature of the material as regards to the sorption of other gas species, with respect to conventional NEG alloys.

Another applicative field which can benefit from the use of getter alloys capable of hydrogen sorption at high temperatures is that of getter pumps. This type of pumps is described in various patents such as U.S. Pat. No. 5,324,172 and U.S. Pat. No. 6,149,392, as well in the international patent publication WO 2010/105944, all in the name of the applicant.

Being able to use the getter material of the pump at high temperature increases the performance thereof in terms of sorption capacity towards other gases.

Another applicative field that benefits from the advantages of a getter material capable of hydrogen and nitrogen sorption at high temperature is the purification of the gases used in semiconductor industries. As a matter of fact, particularly when high flows are requested, typically higher than some l/min, the getter material has to work at high temperatures in order to have a sufficient capacity for the removal of gas contaminants such as $N_2$, $H_2O$, $O_2$, $CH_4$, CO, $CO_2$. Clearly, this condition is unfavorable for hydrogen and nitrogen sorption at the same time, therefore arrangements for operating the purification system with a temperature gradient have been implemented. Typically, the lower portion of the cartridge containing the getter material is cooled or anyway it is allowed to work at lower temperatures than the higher portion, in order to favor the hydrogen sorption. This kind of arrangement is described in U.S. Pat. No. 5,238,469.

Two of the most efficient solutions for hydrogen removal are disclosed in EP 0869195 and in the international patent publication WO 2010/105945, both in the name of the applicant. The first solution makes use of Zirconium-Cobalt-RE alloys wherein RE can be a maximum of 10% and is selected among Yttrium, Lanthanum and other Rare Earths, In particular, the alloy having the following weight percentages: Zr 80.8%-Co 14.2% and RE 5%, marketed by the applicant under the name St 787®, has been particularly appreciated. Instead, the second solution makes use of Yttrium-based alloys in order to maximize the removable amount of hydrogen also at temperatures above 200° C. but their properties of irreversible gas sorption are essentially limited with respect to the needs of many applications requiring vacuum conditions.

A particular solution, useful for quickly gettering hydrogen and other undesired gases such as CO, $N_2$ and $O_2$ is described in U.S. Pat. No. 4,360,445, but the oxygen-stabilized zirconium-vanadium-iron alloy disclosed therein can be successfully used only in a particular range of temperature (i.e. −196° C. to 200° C.) that limits its field of possible application.

Therefore improved characteristics versus hydrogen and nitrogen of the alloys according to the present invention have to be intended and evaluated in a twofold possible meaning, namely an increased overall capacity for $H_2$ (with low hydrogen equilibrium pressure) while retaining the previous properties present when the alloys are used at low (room) temperature also when they are used at high temperature (200° C. or higher). For the most interesting alloys according to the present invention, both these properties should be considered and associated with an unexpected improved sorption performance with respect to $N_2$ when they work at high temperature.

It is therefore an object of the present invention to provide getter devices based on the use of a new non-evaporable getter material capable of overcoming the disadvantages of the prior art, in particular a material capable of having a lower equilibrium pressure of $H_2$ at high temperature and at the same time improved sorption properties versus $N_2$. Moreover, the effective composition of these materials can be selected in the claimed range in order to have different relative sorption properties of $H_2$ with respect to $N_2$, allowing an effective optimization of the vacuum condition according to the gas to be removed and therefore in a large variety of possible systems or devices.

These objects are achieved by a getter device containing powders of a non-evaporable getter alloy, said non-evaporable getter alloy comprising as compositional elements zirconium, vanadium and titanium and having an atomic percentage composition of said elements which can vary within the following atomic percentage ranges:

a. zirconium from 42 to 85%;

b. vanadium from 8 to 50% c. titanium from 5 to 30% said atomic percentage ranges being considered with respect to the sum of zirconium, vanadium and titanium in the non-evaporable getter alloy.

Optionally, the non-evaporable getter alloy composition can further comprise as compositional elements one or more metals selected from the group consisting of iron, chromium, manganese, cobalt, nickel and aluminum in an overall atomic percentage preferably comprised between 0.1 and 7%, more preferably between 0.1 and 5% although for aluminum an amount up to 12% or more preferably equal to or lower than 10% can be accepted. Moreover, minor amounts of other chemical elements can be present in the alloy composition if their overall percentage is less than 1% with respect to the total of the alloy composition.

These and other advantages and characteristics of the alloys and devices according to the present invention will be clear to those skilled in the art from the following detailed description of some embodiments thereof, with reference to the annexed drawings wherein.

Figure 7:
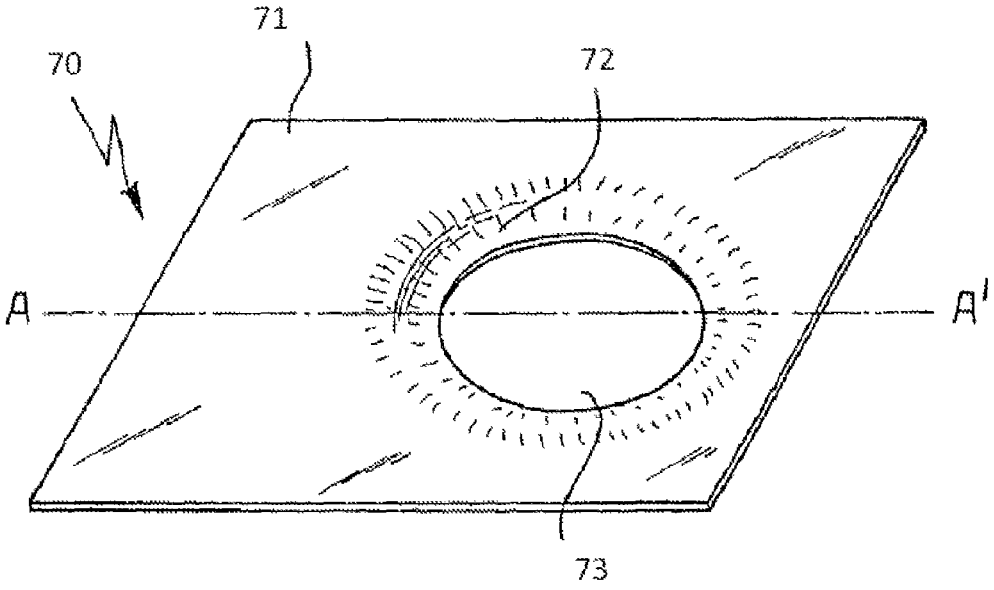
Figure 8:
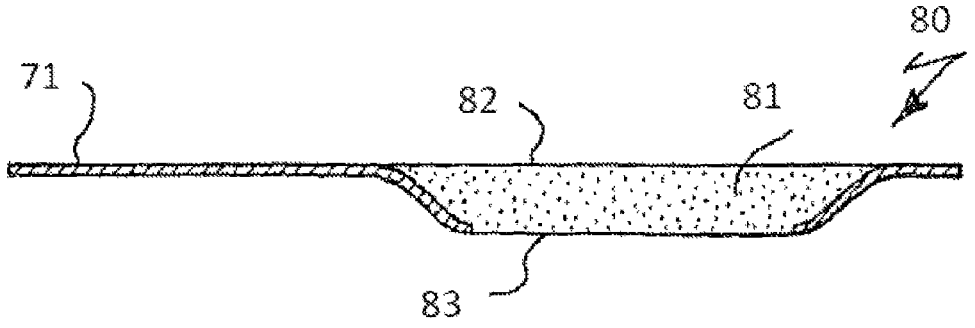
Figure 9:
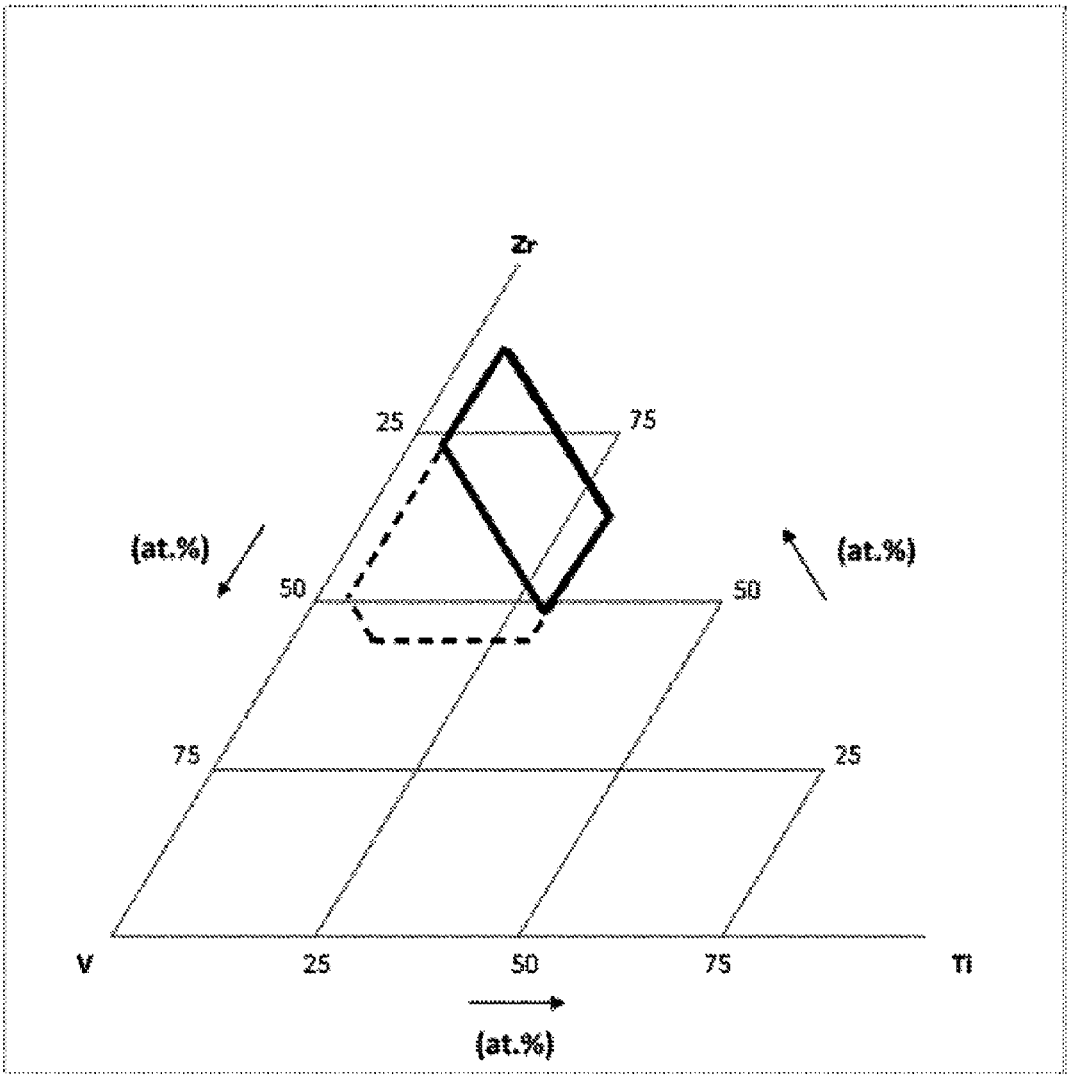
Figure 10:
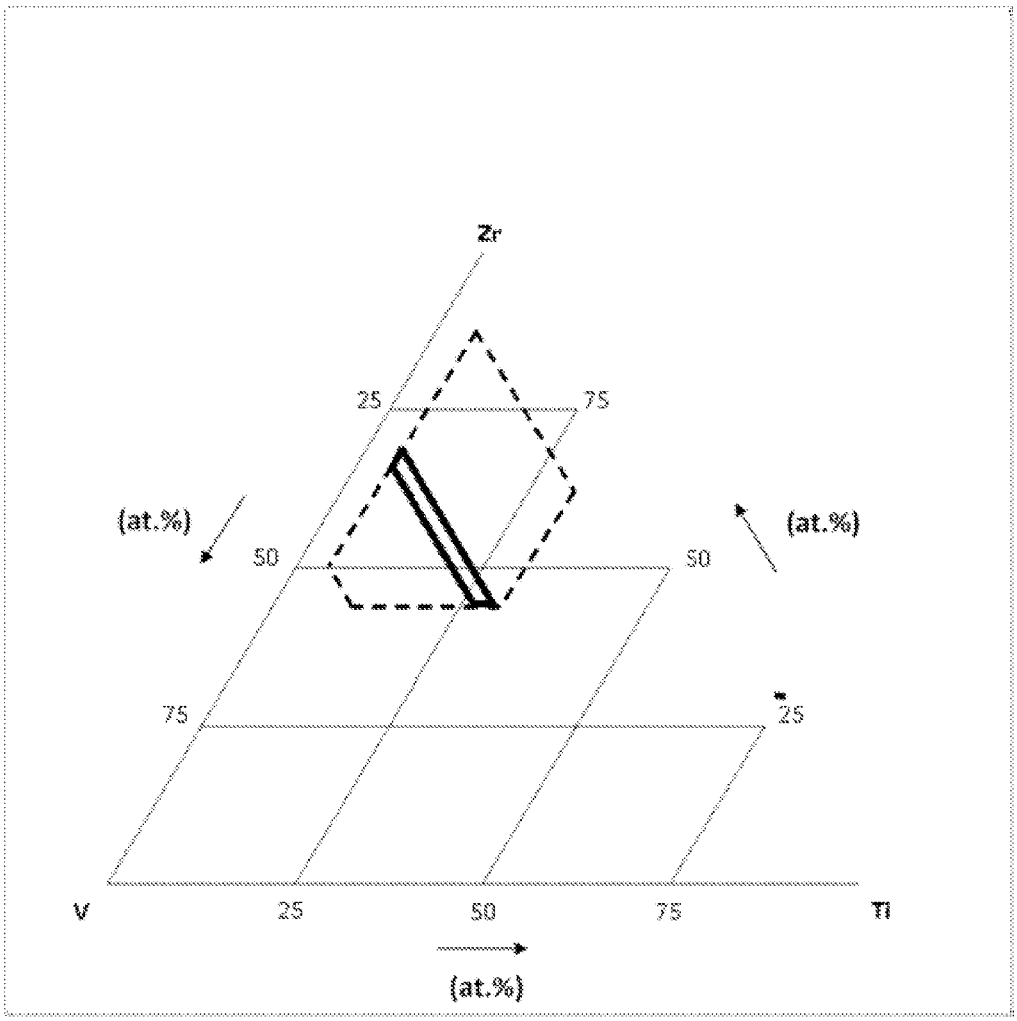
Figure 11:
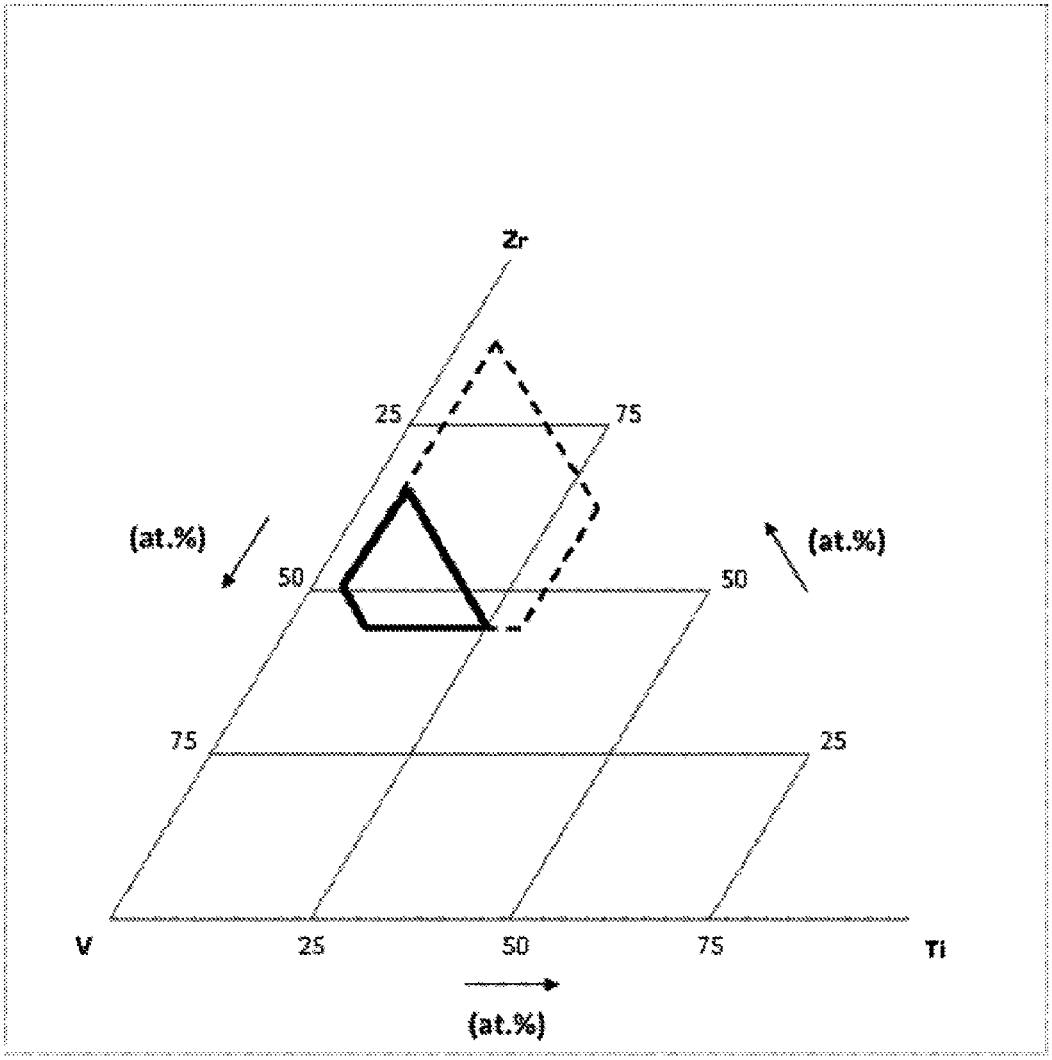

FIGS. 5 to 8 show other getter devices based on alloy powders according to the present invention; and FIGS. 9 to 11 show the Zr—Ti—V ternary diagrams of three types of preferred compositions for specific applications, said types being represented by a smaller polygon drawn with a continuous line within the larger polygon drawn with a broken line that represents the compositions of the present invention.

Figure 1:
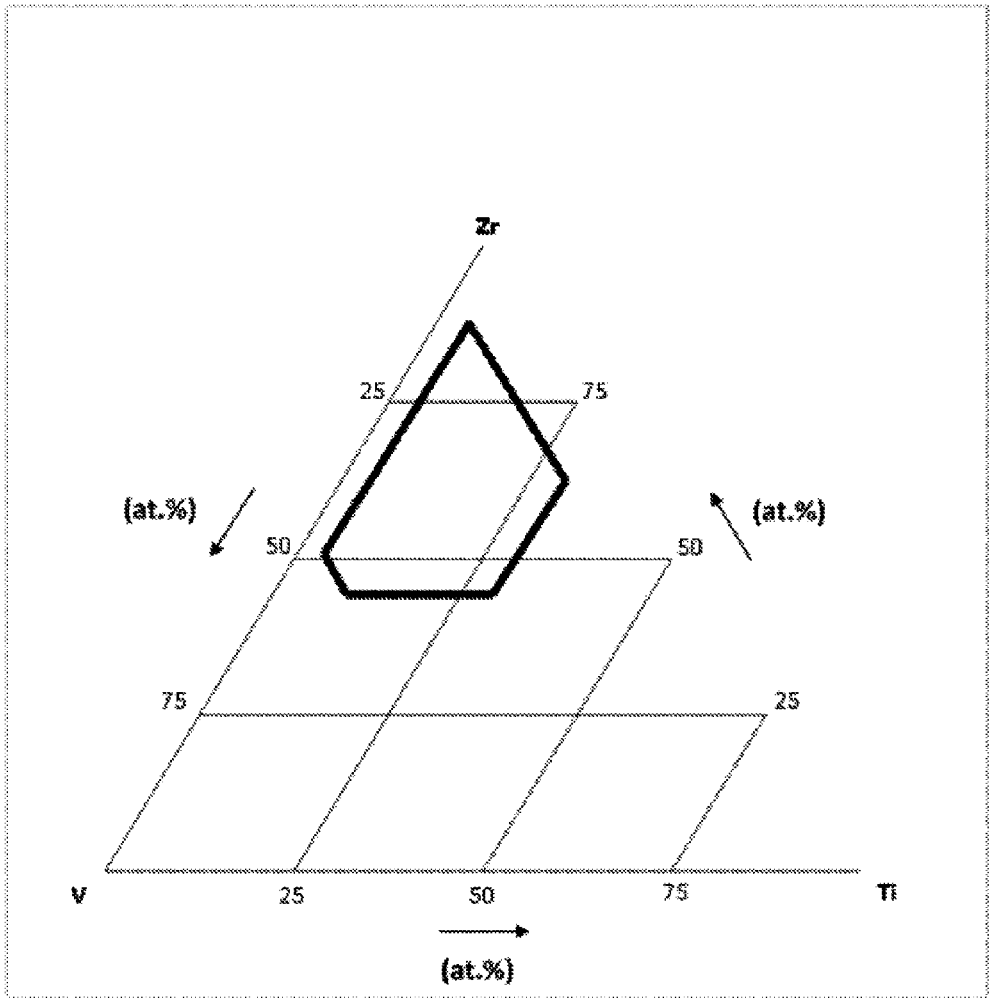
FIG. 1 shows the compositions according to the present invention representing them in a ternary diagram for the Zr—Ti—V system: the interest is concentrated on the compositions contained within the polygon drawn with the continuous line.
Figure 2:
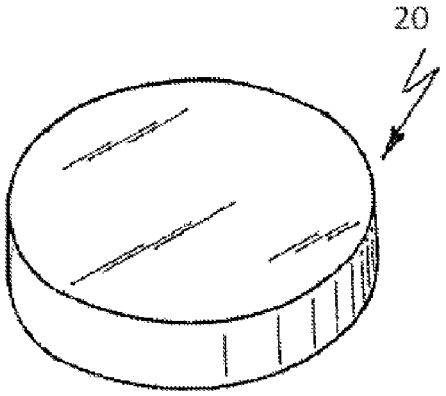
FIGS. 2 to 4 show devices made with a single alloy body according to different possible embodiments.
Figure 3:
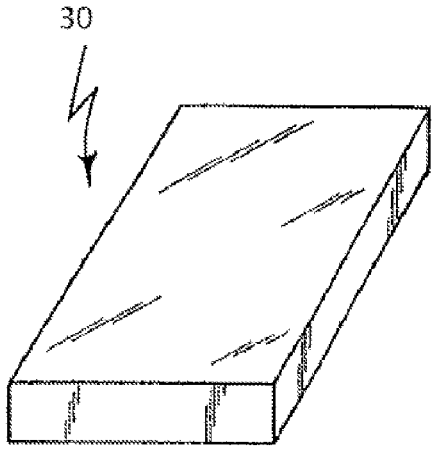

FIGS. 2 and 3 show, respectively, a cylinder 20 and a board 30 made by cutting an alloy sheet of suitable thickness or obtained by compression of alloy powders. For their practical use the devices must be positioned in a fixed position in the container that is to be maintained free from hydrogen. The devices 20 and 30 could be fixed directly to an internal surface of the container, for example by spot welding when said surface is made of metal. Alternatively, devices 20 or 30 can be positioned in the container by means of suitable supports, and the mounting on the support can be carried out by welding or mechanical compression.

Figure 4:
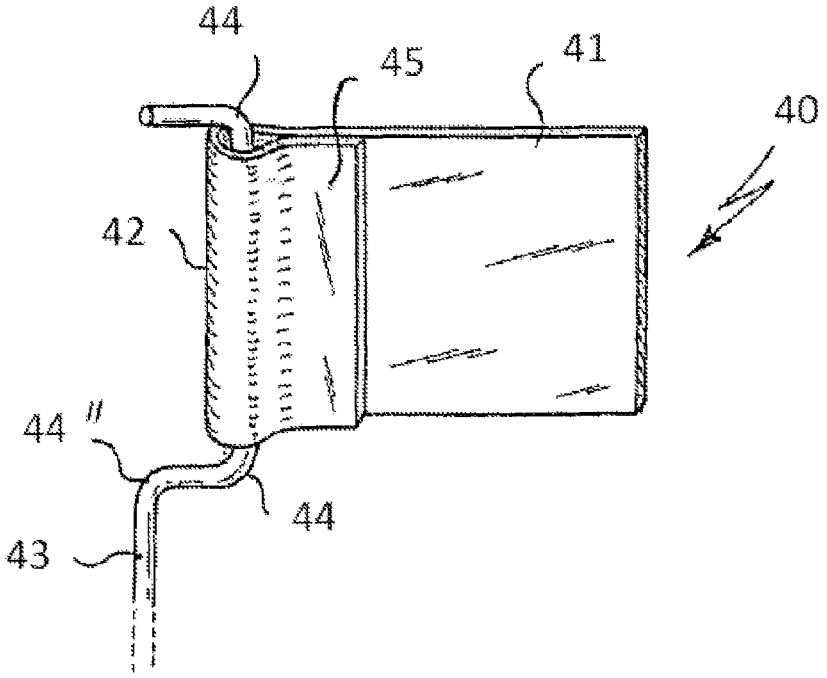

FIG. 4 shows another possible embodiment of a getter device 40, wherein a discrete body of an alloy according to the invention is used, particularly for those alloys having high plasticity features. In this case the alloy is manufactured in the form of a strip from which a piece 41 having a desired size is cut, and the piece 41 is bent in its portion 42 around a support 43 in the form of a metal wire. Support 43 may be linear but it is preferably provided with curves 44, 44', 44" that help the positioning of piece 41, whose shaping can be maintained by means of one or several welding points (not shown in the figure) in the overlapping zone 45, although a simple compression during the bending around support 43 can be sufficient considering the plasticity of these alloys.

Alternatively, other getter devices according to the invention can be manufactured by using powders of the alloys. In the case that powders are used, these preferably have a particle size lower than 500 μm, and even more preferably lower than 300 μm, in some applications being to be included between 0 and 125 μm.

Figure 5:
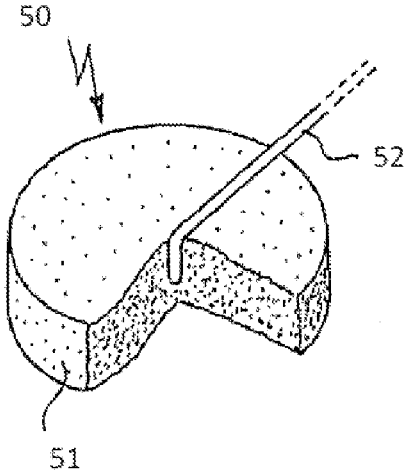

FIG. 5 shows a broken view of a device 50, having the shape of a tablet 51 with a support 52 inserted therein; such a device can be made for example by compression of powders in a mould, having prepared support 52 in the mould before pouring the powder. Alternatively, support 52 may be welded to tablet 51.

Figure 6:
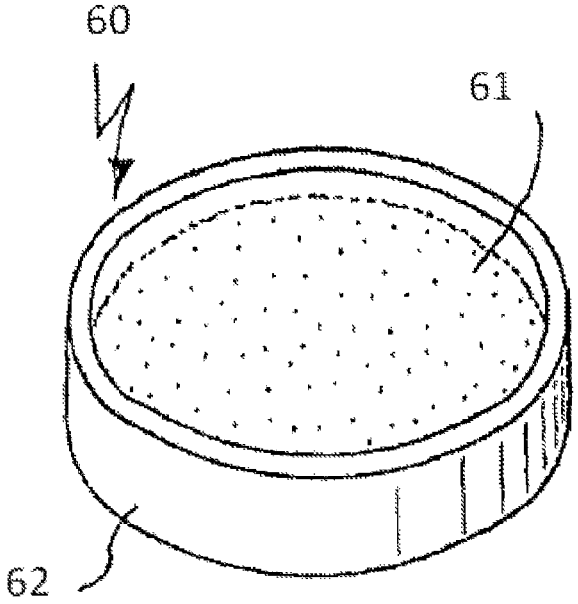

FIG. 6 shows a device 60 formed by powders of an alloy 61 according to the invention pressed in a metal container 62; device 60 may be fixed to a support (not shown in the figure) for example by welding container 62 thereto.

Finally, FIGS. 7 and 8 show another kind of device comprising a support 70 manufactured starting from a metal sheet 71 with a depression 72, obtained by pressing sheet 71 in a suitable mould. Most of the bottom part of depression 72 is then removed by cutting, obtaining a hole 73, and support 70 is kept within the pressing mould so that depression 72 can be filled with alloy powders which are then pressed in situ thus obtaining device 80 (seen in the section taken along line A-A' of FIG. 7) in which the powder package 81 has two exposed surfaces, 82 and 83, for the gas sorption.

In all the devices according to the invention the supports, containers and any other metal part which is not formed of an alloy according to the invention is made of metals having a low vapor pressure, such as tungsten, tantalum, niobium, molybdenum, nickel, nickel iron or steel in order to prevent these parts from evaporating due to the high working temperature to which said devices are exposed.

The alloys useful for the getter devices according to the invention can be produced by melting the pure elements, preferably in powder or pieces, in order to obtain the desired atomic ratios. The melting must be carried out in a controlled atmosphere, for example under vacuum or inert gas (argon is preferred), in order to avoid the oxidation of the alloy which is being prepared. Among the most common melting technologies, but not limited to, arc melting, vacuum induction melting (VIM), vacuum arc remelting (VAR), induction skull melting (ISM), electro slug remelting (ESR), or electron beam melting (EBM) can be used. The sintering or high pressure sintering of the powders may also be employed to form many different shapes such as discs, bars, rings, etc. of the non-evaporable getter alloys of the present invention, for example to be used within getter pumps. In a possible embodiment of the present invention, moreover, sintered products can be obtained by using mixtures of getter alloy powders having a composition according to claim 1 optionally mixed with metallic powders such as, for example, titanium, zirconium or mixtures thereof, to obtain getter elements, usually in the form of bars, discs or similar shapes as well described for example in EP 0719609.

The inventors discovered that the getter devices according to the present invention are particularly advantageous for some applications, because of some constraints or particular features which are required.

In particular, in the case of a concentrating solar power system it is preferred to use alloys which are able to sorb hydrogen even at the relatively high working temperatures of 200° C. In this kind of application the preferred alloys are those with an atomic percentage of vanadium comprised between 8 and 23% with respect to the sum of titanium, vanadium and zirconium in the alloy composition (FIG. 9).

While the use of alloys with an atomic percentage of vanadium comprised between 28 and 30% with respect to the sum of titanium, vanadium and zirconium in the alloy composition (FIG. 10) is particularly advantageous in the case of lamps, the inventors have also noted that said alloys can be useful both to help the exhaust process of the lamp in removing the residual air in the bulb at the end of the production and to keep a low pressure during the lamp life by sorbing the hydrogen and water vapor usually outgassed in the operating conditions. Moreover these alloys can be a good solution for retarding the undesired pressure increase related to the possible presence of a leak in the lamp structure.

In the field of gas purification these materials are typically hosted within a suitable container having an inlet, an outlet and thermoregulating means. In the case of impurities removal from an argon flow, the preferred alloys are those with an atomic percentage of vanadium comprised between 37 and 47% with respect to the sum of titanium, vanadium and zirconium in the alloy composition (FIG. 11).

In the field of getter pumps, the requirement is sorbing hydrogen in an effective way by operating at high temperatures, for example at 200° C., in such a way that the getter material is capable of effectively sorbing also the other gas impurities $N_2$, $H_2O$, $O_2$, $CH_4$, CO, $CO_2$ possibly present in the chamber that is to be evacuated. In this case, all the alloys which are the subject-matter of the present invention have features that are advantageous in this application, whereby those having higher affinity toward gas impurities at higher temperatures are particularly appreciated. The preferred alloys are therefore those with an atomic percentage of vanadium comprised between 30 and 47%, and more preferably between 37 and 47%, with respect to the sum of titanium, vanadium and zirconium in the alloy composition (FIG. 11).

In a second aspect thereof, the invention consists in the use of a getter device as described above for hydrogen and nitrogen removal. For example, said use can be directed to hydrogen and nitrogen removal from a closed system or device including or containing substances or structural elements which are sensitive to the presence of said gases. Alternatively, said use can be directed to hydrogen and nitrogen removal from gas flows used in manufacturing processes involving substances or structural elements which are sensitive to the presence of said gases. Hydrogen and nitrogen negatively affect the characteristics or performances of the device and said undesired effect is avoided or limited by means of at least a getter device containing a non-evaporable getter alloy comprising as compositional elements zirconium, vanadium and titanium and having an atomic percentage composition of said elements which can vary within the following ranges:

a. zirconium from 42 to 85%;
b. vanadium from 8 to 50%
c. titanium from 5 to 30% said atomic percentage ranges being considered with respect to the sum of zirconium, vanadium and titanium in the non-evaporable getter alloy.

The use according to the invention finds application by using the getter alloy in the form of powder, of powders pressed in pills, laminated on suitable metal sheets or positioned inside one of the suitable containers, possible variants being well known to the person skilled in the art. Alternatively, the use according to the invention can find application by using the getter alloy in the form of sintered (or high-pressure sintered) powders, optionally mixed with metallic powders such as, for example, titanium or zirconium or mixtures thereof.

The considerations above regarding the positioning of the getter material according to the present invention are general and are suitable for the employment thereof independently of the mode of use of the material or of the particular structure of its container.

In a third aspect thereof, the invention consists in a hydrogen-sensitive device wherein hydrogen and nitrogen are removed by means of a getter device based on a non-evaporable getter alloy comprising as compositional elements zirconium, vanadium and titanium and having an atomic percentage composition of said elements which can vary within the following ranges:

a. zirconium from 42 to 85%;
b. vanadium from 8 to 50%
c. titanium from 5 to 30% said atomic percentage ranges being considered with respect to the sum of zirconium, vanadium and titanium in the non-evaporable getter alloy.

Non-limiting examples of hydrogen-sensitive devices which can obtain particular benefits from the use of the above-described getter devices are solar receivers, vacuum bottles, vacuum insulated flowlines (e.g. for steam injection), electronic tubes, dewars, etc.

Polycrystalline ingots can be prepared by arc melting of appropriate mixtures of the high purity constituent elements in an argon atmosphere. The ingot can be then grinded by ball milling in a stainless steel jar under argon atmosphere and subsequently sieved to a desired powder fraction, usually of less than 500 μm or more preferably less than 300 μm in particle size.

The invention will be further illustrated by means of the following example. This non-limiting example illustrates some embodiments which are intended to teach the skilled person how to put the invention into practice.

EXAMPLE 1

150 mg of each alloy listed in table 1 (see below) were pressed in annular containers in order to obtain the samples labeled as sample A, B, C, D, E, F, G (according to the present invention) and reference 1, 2 and 3. They have been compared in their sorption performance versus hydrogen and nitrogen.

The test for $N_2$ sorption capacity evaluation is carried out on an ultra-high vacuum bench. The getter sample is mounted inside a bulb and an ion gauge allows to measure the pressure on the sample, while another ion gauge allows to measure the pressure upstream of a conductance located between the two gauges. The getter is activated with a radiofrequency oven at 400° C.×60 min, afterwards it is cooled and kept at 200° C. A flow of $N_2$ is passed on the getter through the known conductance, keeping a constant pressure of $10^{-5}$ torr. Measuring the pressure before and after the conductance and integrating the pressure change in time, the pumping speed and the sorbed quantity of the getter can be calculated. The recorded data have been reported in table 1.

The test for $H_2$ equilibrium isotherm measurement is carried out on a high-vacuum bench built with a sample volume and a loading volume, separated by a valve. The getter sample, mounted in a bulb in the sample volume, is activated with a radiofrequency oven at 700° C.×60 min, then the sample is cooled and kept at 200° C. After isolating the system from the pumps, the getter is exposed to several $H_2$ doses from the loading volume. After the sorption of each dose, the equilibrium pressure is recorded. The data obtained represent the isotherms of the equilibrium pressure of $H_2$ versus the hydrogen concentration, the final capacity at a fixed pressure has been calculated and reported in table 1.

In table 2, referring to the compositions shown in table 1, the relative atomic percentages of each element selected among Zr, Ti and V have been reported with respect to the atomic percentage of the sum of these three elements in the non-evaporable getter alloys.

TABLE 1

| Sample | Zr (at. %) | Ti (at. %) | V (at. %) | Al (at. %) | Fe (at. %) | Co (at. %) | RE (at. %) | $N_2$ capacity cc Torr/g | $H_2$ capacity Torr L/g |
|---|---|---|---|---|---|---|---|---|---|
| sample A | 43 | 14 | 43 | — | — | — | — | 3206 | 135 |
| sample B | 62 | 9 | 29 | — | — | — | — | 482 | 156 |
| sample C | 69 | 8 | 23 | — | — | — | — | 70 | 160 |
| sample D | 45 | 15 | 30 | 10 | — | — | — | 208 | 120 |
| sample E | 68 | 17 | 12.5 | — | 2.5 | — | — | 22 | 167 |
| sample F | 49 | 16 | 29.2 | — | 5.8 | — | — | 50 | 119 |
| sample G | 40 | 15 | 33.8 | 11.2 | — | — | — | 170 | 110 |
| reference 1 | 29 | 14 | 57 | — | — | — | — | 9 | 80 |
| reference 2 | 47 | 12 | 41 | — | — | — | — | 36 | 101 |
| reference 3 | 81 | — | — | — | — | 14 | 5 | 2 | 97 |

TABLE 2

| Sample | Zr/Zr + Ti + V (at. %) | Ti/Zr + Ti + V (at. %) | V/Zr + Ti + V (at. %) |
|---|---|---|---|
| sample A | 43 | 14 | 43 |
| sample B | 62 | 9 | 29 |
| sample C | 69 | 8 | 23 |
| sample D | 50 | 17 | 33 |
| sample E | 70 | 17 | 13 |
| sample F | 52 | 17 | 31 |
| sample G | 45 | 17 | 38 |
| reference 1 | 29 | 14 | 57 |
| reference 2 | 47 | 12 | 41 |
| reference 3 | 100 | 0 | 0 |

The invention claimed is:

1. A getter device containing non-evaporable getter alloy powders having high gas sorption efficiency, particularly for hydrogen and nitrogen, said alloy powders comprising as compositional elements zirconium, vanadium and titanium and having an atomic percentage composition of said elements which can vary within the following ranges:

zirconium from 42% to 85%;

vanadium from 8% to 50%;

titanium from 5% to 30%, said atomic percentage ranges being considered respect to a sum of zirconium, vanadium and titanium in the non-evaporarable getter alloy that can further comprise as compositional elements one or more metals selected from the group consisting of iron, chromium, manganese, cobalt, nickel and aluminum, wherein other chemical elements can be present in the alloy composition only if their overall percentage is less than 1% by atomic percentage with respect to the total of the alloy composition.

2. The getter device according to claim 1, wherein the atomic percentage of vanadium is comprised between 30% and 47%.

3. The getter device according to claim 2, wherein the atomic percentage of vanadium is comprised between 37% and 47%.

4. The getter device according to claim 1, wherein the atomic percentage of vanadium is comprised between 28% and 30%.

5. The getter device according to claim 1, wherein the atomic percentage of vanadium is comprised between 8% and 23%.

6. The getter device according to claim 1, wherein said alloy further comprises in its composition one or more additional elements selected from the group consisting of iron, chromium, manganese, cobalt or nickel in an atomic percentage composition comprised between 0.1% and 7%, more preferably between 0.1% and 5%, with respect to the total alloy composition.

7. The getter device according to claim 1, wherein said alloy further comprises in its composition aluminum as additional element in an atomic percentage composition comprised between 0.1% and 12% more preferably between 0.1% and 10%, with respect to the total alloy composition.

8. The getter device according to claim 1, wherein said getter alloy powders are mixed with metal powders, said metal powders being preferably selected between titanium and zirconium or mixtures thereof.

9. The getter device according to claim 1, wherein said alloy powders have a particle size lower than 500 μm, preferably lower than 300 μm.

10. A hydrogen-sensitive device containing the getter device according to claim 1.

* * * * *